US009273254B2

(12) United States Patent
Compton et al.

(10) Patent No.: US 9,273,254 B2
(45) Date of Patent: Mar. 1, 2016

(54) AMINO ACETALS AND KETALS AS HYDROGEN SULFIDE AND MERCAPTAN SCAVENGERS

(71) Applicant: Ecolab USA Inc., Eagan, MN (US)

(72) Inventors: Dennis R. Compton, Sugar Land, TX (US); Kekeli Ekoue-Kovi, Sugar Land, TX (US)

(73) Assignee: Ecolab USA Inc., Eagan, MN (US)

( * ) Notice: Subject to any disclaimer, the term of this patent is extended or adjusted under 35 U.S.C. 154(b) by 249 days.

(21) Appl. No.: 14/137,201

(22) Filed: Dec. 20, 2013

(65) Prior Publication Data

US 2015/0175903 A1 Jun. 25, 2015

(51) Int. Cl.

| | |
|---|---|
| ***C10G 29/20*** | (2006.01) |
| *C10G 29/00* | (2006.01) |
| *C10G 29/22* | (2006.01) |

(52) U.S. Cl.
CPC ..... *C10G 29/20* (2013.01); *C10G 2300/202* (2013.01); *C10G 2300/207* (2013.01)

(58) Field of Classification Search
CPC ..... C10G 29/00; C10G 29/20; C10G 29/22
See application file for complete search history.

(56) References Cited

U.S. PATENT DOCUMENTS

| | | | |
|---|---|---|---|
| 4,421,733 | A | 12/1983 | Blytas |
| 4,569,766 | A | 2/1986 | Kool et al. |
| 4,680,127 | A | 7/1987 | Edmondson |
| 5,128,049 | A | 7/1992 | Gatlin |
| 5,225,103 | A | 7/1993 | Hoffmann et al. |
| 5,674,377 | A | 10/1997 | Sullivan, III et al. |
| 6,887,447 | B2 | 5/2005 | Schield et al. |
| 7,078,005 | B2 | 7/2006 | Smith et al. |
| 7,216,710 | B2 | 5/2007 | Welton et al. |
| 2004/0096382 | A1 | 5/2004 | Smith et al. |
| 2006/0223852 | A1 * | 10/2006 | Gillespie ..... C07D 231/14 514/314 |
| 2007/0284288 | A1 | 12/2007 | Gatlin |
| 2011/0315921 | A1 | 12/2011 | Ramachandran et al. |
| 2012/0012507 | A1 | 1/2012 | Compton et al. |

FOREIGN PATENT DOCUMENTS

| | | | |
|---|---|---|---|
| EP | 0 279 667 | A2 | 8/1988 |
| EP | 0 882 778 | A2 | 9/1998 |
| EP | 1 363 985 | B1 | 8/2007 |
| EP | 2 465 975 | A1 | 6/2012 |
| WO | 02/051968 | A1 | 7/2002 |
| WO | 2012/128935 | A2 | 9/2012 |

OTHER PUBLICATIONS

Kelland, M. A., "Hydrogen Sulfide Scavengers," Production Chemicals for the Oil and Gas Industry, Chapter 15, 2009, pp. 363-376.

Kissel, C. L., et al., "Factors Contributing to the Ability of Acrolein to Scavenge Corrosive Hydrogen Sulfide," Society of Petroleum Engineers Journal, Oct. 1985, pp. 647-655.

* cited by examiner

*Primary Examiner* — Brian McCaig
(74) *Attorney, Agent, or Firm* — Senniger Powers LLP

(57) ABSTRACT

The present invention generally relates to compositions and methods for scavenging hydrogen sulfide and/or mercaptans from fluids. More particularly, the invention relates to the use of amino acetal and ketal compounds as a hydrogen sulfide or a mercaptan scavenger for hydrocarbon fluids, particularly for natural gas, crude oil, field oil, fuel oil, naphtha, gasoline, kerosene, diesel, refinery gas, coal gas, tar, asphalt, coke gas, ammonia synthesis gas, gas from a sulfurization plant, or industrial gas streams.

22 Claims, 1 Drawing Sheet

AMINO ACETALS AND KETALS AS HYDROGEN SULFIDE AND MERCAPTAN SCAVENGERS

FIELD OF THE INVENTION

The present invention generally relates to compositions and methods for scavenging hydrogen sulfide and/or mercaptans from fluids. More particularly, the invention relates to the use of amino acetal and ketal compounds as a hydrogen sulfide or a mercaptan scavenger for hydrocarbon fluids, particularly for natural gas, crude oil, field oil, fuel oil, naphtha, gasoline, kerosene, diesel, refinery gas, coal gas, tar, asphalt, coke gas, ammonia synthesis gas, gas from a sulfurization plant, or industrial gas streams.

BACKGROUND OF THE INVENTION

Hydrogen sulfide is a toxic, corrosive, flammable gas that causes problems in both the upstream and downstream oil and gas industry. Exposure to this gas, even at low concentrations, can cause serious injury or death. Hydrogen sulfide ($H_2S$) in natural gas and crude oil reserves is often accompanied by small amounts of mercaptans (RSH), sulfides ($R_2S$), polysulfides, and carbonyl sulfide (COS). Considerable expense and effort are expended annually to reduce the $H_2S$ content of gas and oil streams to make them suitable for commercial use.

Hydrogen sulfide has an offensive odor, and natural gas and crude oil streams containing substantial amounts of $H_2S$ are considered "sour." In addition to natural gas and petroleum, there are also aqueous fluids that must be treated to reduce or remove $H_2S$, such as waste water streams. Treatments to reduce or remove $H_2S$ from hydrocarbon or aqueous streams are referred to as "sweetening" treatments because the odor of the processed products is improved by the absence of hydrogen sulfide. A chemical compound that is used to remove or reduce $H_2S$ levels sometimes is called a "scavenger" or "scavenging agent." Scavengers that react irreversibly with hydrogen sulfide or other sulfur species and convert them to a more inert form are considered nonregenerative.

In large production facilities, the most economical solution to remove $H_2S$ from a sour gas stream is to install a regenerative system. These systems typically employ a compound used in an absorption tower to contact the produced fluid and form weakly bound soluble salts which become unstable at elevated temperatures. The absorption compound, usually alkanolamines such as N-methyldiethanolamine (MDEA), and $H_2S$ are then regenerated by various means using heat, pressure reduction, or a combination thereof. The absorption material is reused in the system, and the separated $H_2S$ is treated by a modified Claus process to form elemental sulfur.

For hydrocarbon streams with small concentrations of hydrogen sulfide, the use of scavengers in batch treatments and continuous injection processes can provide a cost-effective alternative to conventional gas/liquid sweetening processes. Known hydrogen sulfide scavengers include solid scavengers (e.g. zinc-based or iron-based materials), oxidizing chemicals (e.g. chlorites, nitrites, bromates, iodates, and peroxides), aldehydes (e.g. formaldehyde, glutaraldehyde, acrolein, and glyoxal), reaction products of aldehydes and amines (e.g. triazines), metal carboxylates and other chelates, and other amine based products (e.g. amidines, maleimides, and amine oxides). (See Production Chemicals for the Oil and Gas Industry, CRC Press, 2010, Chapter 15, "Hydrogen Sulfide Scavengers," pg. 363-375).

Although the application of hydrogen sulfide scavengers is widely practiced in production and processing operations in the oil and gas industries, known scavengers have one or more limitations ranging from exorbitant prices to health, safety, and environmental problems. Thus, a continuing need exists for alternative hydrogen sulfide scavengers that overcome these deficiencies.

SUMMARY OF THE INVENTION

A method of reducing the amount of hydrogen sulfide or a mercaptan in a hydrocarbon fluid is provided. The method comprises contacting the hydrocarbon fluid with an effective amount of a composition comprising a compound of formula 1 having the structure:

Formula 1

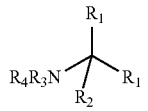

wherein $R_1$ is independently —$NR_3R_4$, —$O(CH_2)_nNR_5R_6$, or —$OR_7$; $R_2$, $R_3$, $R_4$, $R_5$, and $R_6$ are independently hydrogen, alkyl, alkenyl, or alkynyl; $R_7$ is alkyl, alkenyl, or alkynyl; n is and integer from 1 to 10.

Another method of reducing the amount of hydrogen sulfide or a mercaptan in a hydrocarbon fluid is provided. The method comprises contacting the hydrocarbon fluid with an effective amount of a composition comprising a compound of formula 2 or 3 having the structure:

Formula 2

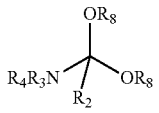

Formula 3

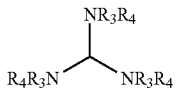

wherein $R_8$ is independently alkyl, alkenyl, alkynyl, or —$(CH_2)_nNR_5R_6$.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
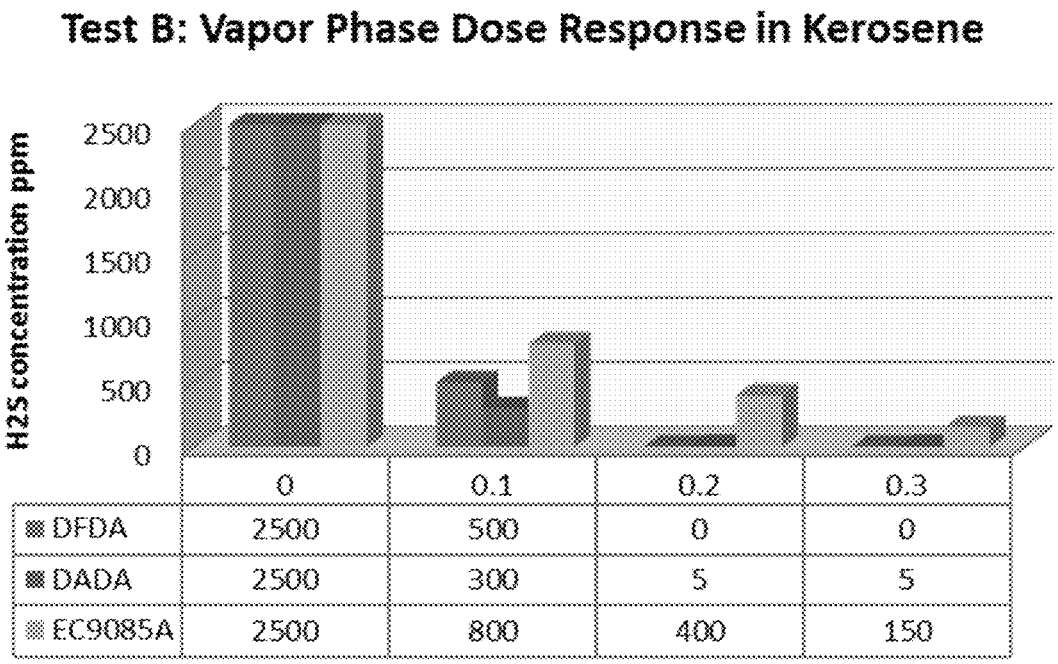
FIG. 1 is a graph of the hydrogen sulfide concentration in the vapor phase of a kerosene sample for N,N-dimethylformamide dimethyl acetal (DFDA), N,N-dimethylacetamide dimethyl acetal (DADA) and Nalco Champion SULFA-CHECK™ EC9085A) at ratios of 0.1, 0.2, and 0.3 based on the ratio of the concentration of scavenger compound to the concentration of hydrogen sulfide.
Figure 2:
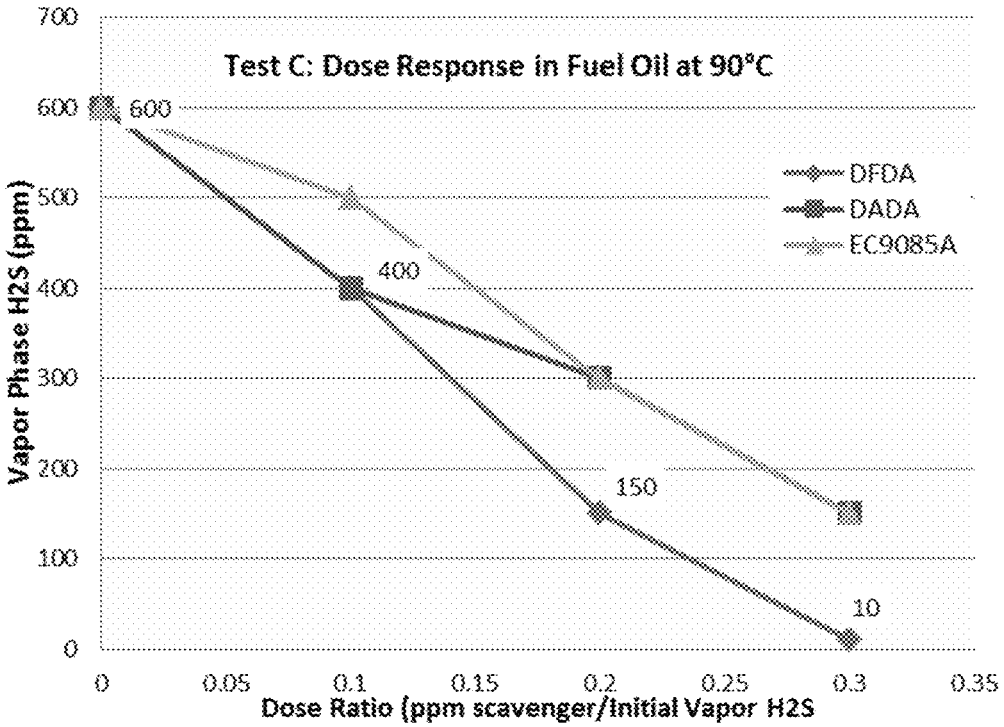
FIG. 2 is a graph of the dose response in the vapor phase of a fuel oil sample for DFDA, DADA and SULFA-CHECK™ EC9085A at ratios of 0.1, 0.2, and 0.3 based on the ratio of the concentration of scavenger compound to the concentration of hydrogen sulfide.

New hydrogen sulfide and mercaptan scavengers as disclosed herein provide effective reduction of hydrogen sulfides and mercaptans with minimal health, environmental, and safety issues. Thus, the scavengers provide an effective alternative to commercial scavengers.

One aspect of the present invention is a method of reducing the amount of hydrogen sulfide or a mercaptan in a hydrocarbon fluid. The method comprises contacting the hydrocarbon fluid with an effective amount of a scavenger composition comprising a compound of formula 1 having the structure:

Formula 1

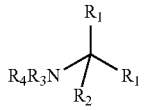

wherein $R_1$ is independently —$NR_3R_4$, —$O(CH_2)_nNR_5R_6$, or —$OR_7$; $R_2$, $R_3$, $R_4$, $R_5$, and $R_6$ are independently hydrogen, alkyl, alkenyl, or alkynyl; $R_7$ is alkyl, alkenyl, or alkynyl; n is and integer from 1 to 10; and $R_2$ is hydrogen when $R_1$ is —$NR_3R_4$.

Another aspect is a method of reducing the amount of hydrogen sulfide or a mercaptan in a hydrocarbon fluid. The method comprises contacting the hydrocarbon fluid with an effective amount of a scavenger composition comprising a compound of formula 2 or 3 having the structure:

Formula 2

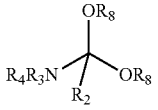

Formula 3

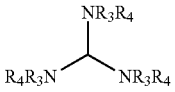

wherein $R_8$ is independently alkyl, alkenyl, alkynyl, or —$(CH_2)_nNR_5R_6$.

For compounds of Formulae 1 to 3, $R_3$, $R_4$, $R_5$, $R_6$, $R_7$ and $R_8$ can be $C_1$ to $C_{20}$ alkyl and $R_2$ can be hydrogen or $C_1$ to $C_{20}$ alkyl.

Further, for compounds of Formulae 1 to 3 disclosed herein, $R_3$, $R_4$, $R_5$, $R_6$, $R_7$ and $R_8$ can independently be methyl, ethyl, propyl, butyl, pentyl, or hexyl.

For compounds of Formulae 1 to 3, $R_7$ or $R_8$ can be methyl or ethyl; preferably, $R_7$ or $R_8$ is methyl.

Additionally, for Formulae 1 to 3, $R_2$ can be hydrogen, methyl or ethyl.

For all of the compounds of Formulae 1 to 3 described herein, $R_3$ and $R_4$ can independently be hydrogen, methyl, ethyl, propyl, or butyl. Preferably, $R_3$ and $R_4$ can be methyl.

Also, for compounds of Formulae 1 to 3, $R_5$ and $R_6$ can independently be hydrogen, methyl, ethyl, propyl or butyl.

Further, for compounds of Formulae 1 to 3, $R_2$ can be hydrogen or methyl.

The compound of Formula 1 can be N,N-dimethylformamide dimethyl acetal (DFDA), N,N-dimethylacetamide dimethyl acetal (DADA), or N,N-dimethylformamide diethyl acetal (DFDEA).

Particularly, the compound of Formula 1 can be DFDA.

Additionally, the compound of Formula 1 can be DADA.

The methods of the invention can be used to reduce hydrogen sulfide or mercaptans in a hydrocarbon fluid that is a liquid or a gas. When the hydrocarbon fluid is a liquid, the liquid is crude oil, field oil, asphalt, fuel oil, naphtha, gasoline, kerosene, or diesel. Preferably, the hydrocarbon liquid is crude oil.

When the hydrocarbon fluid is a gas, the gas can be natural gas, refinery gas, coal gas, coke gas, ammonia synthesis gas, gas from a sulfurization plant, or an industrial gas stream.

The amount of the scavenger composition used will depend on the amount of hydrogen sulfide and/or mercaptan in the hydrocarbon fluid being treated. In general, the amount of the scavenger composition added to the medium is at least an effective scavenging amount. Typically, the effective amount of the scavenger composition contains from about 5 ppm to about 10,000 ppm compound of any one of Formulae 1 to 3 in the hydrocarbon fluid.

The total feed rate of the hydrogen sulfide scavenger will generally be determined by the operator of the specific production process including the scavenging treatment. Those of ordinary skill in the art operating such a process will know how to determine the specific operating parameters of their unit. The effective amount of the hydrogen sulfide scavenger can be adjusted in the field based on the concentration of hydrogen sulfide or mercaptans present in the hydrocarbon fluid to be treated.

The methods can further comprise storing the hydrocarbon fluid in a storage tank, rail car, tank truck, or pipeline after it is contacted with the composition. Preferably, the hydrocarbon fluid is stored in a storage tank.

The scavenger composition is injected into, or otherwise brought into contact with, the hydrocarbon fluid in any convenient manner. For example, the scavenger composition may be injected into the hydrocarbon fluid upstream of a refining unit as the fluid passes through a turbulent section of piping. Also, the scavenger composition can be admixed with a hydrocarbon fluid in a holding vessel that is agitated. Further, the scavenger composition can be admixed with the hydrocarbon fluid immediately upstream of a refining unit by injecting it into a turbulent flow. Still further, the scavenger composition can be atomized and added to a vaporous hydrocarbon stream using, for example, an injection quill.

The methods can be performed wherein the scavenger composition is contacted with the hydrocarbon fluid by injecting the composition into a run-down line for the hydrocarbon fluid. The scavenger composition can also be injected into hydrocarbon fluid using a bubble tower contactor. The scavenger composition can be injected as part of a continuous or batch process.

The methods can also include contacting the scavenger composition with the hydrocarbon fluid by injecting the composition into a storage tank with mixing.

The scavenger composition used can include the compounds of Formulae 1 to 3 neat or diluted with a solvent, and may be formulated with other suitable materials or additives, such as dispersants and corrosion inhibitors. For liquid systems, suitable solvents for dissolving the compounds include polar and nonpolar solvents. Preferred solvents include water, glycol, ethyl acetate, acetone, benzene, toluene, xylene, kerosene, and aromatic naphtha. The amount of solvent used is typically limited to the minimum amount necessary to place the scavenger in an easy-to handle, liquid form.

The compounds of Formulae 1 to 3 can have a wide variety of concentrations in the scavenger composition. Typically, the compound of Formulae 1 to 3 is present at a concentration of from about 32 wt. % to about 100 wt. %.

The scavenger composition can consist essentially of or consist of the compound of Formula 1, 2, or 3.

The scavenger composition can also be used in applications outside of a refining process. For example, when the application to be treated is an oil well, the scavenger composition can be introduced downhole or into the above ground equipment. The scavenger composition can also be introduced into pipelines, storage vessels, and mobile vessels such as trucks, rail cars, and ship holds. The scavenger compositions can be actively or passively mixed with the hydrocarbon fluid being treated.

The temperature at which the scavenger is contacted with the hydrocarbon stream may be between about 24 and 100° C. More preferably, the temperature is between about 24 and 50° C.

Another aspect of the present invention is a method of reducing the amount of hydrogen sulfide or a mercaptan in an aqueous fluid having a high concentration of hydrogen sulfide or a mercaptan. The method comprises contacting a scavenger composition with the aqueous fluid. The aqueous fluid can include an aqueous stream of a water injection system, waste water associated with a hydrocarbon treatment system, a waste water stream in transit to or from a wastewater treatment facility, or waste water from a tanning facility.

The compounds of Formula 2 can be prepared using Reaction Scheme 1 wherein $R_2$, $R_3$, $R_4$ and $R_8$ are as defined herein, and Me is methyl.

Scheme 1

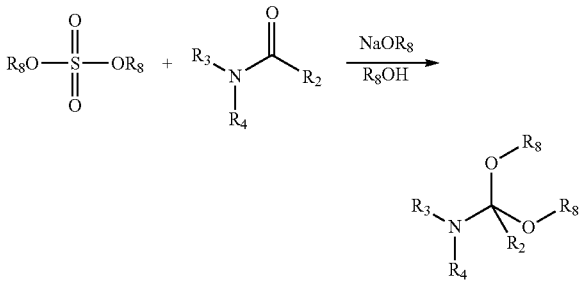

Equimolar amounts of dialkyl sulfate and the amide reactant are combined under nitrogen to form a mixture. The mixture is heated at 80° C. for about two hours, cooled and washed with a solvent such as anhydrous benzene and ether. The traces of solvent are eliminated under reduced pressure. An equimolar solution of $NaOR_8$ in $R_8OH$ at −10° C. is then added slowly to the complex obtained in the first step. The reaction mixture is then brought to room temperature and distilled under reduced pressure and collected at 40° C. in a container containing a drying agent such as magnesium sulfate. The product can be redistilled to remove $R_8OH$ to obtain the product in good yield.

DFDA, DFDEA, and DADA are commercially available from Sigma-Aldrich of St. Louis, Mo. and from BASF.

The compounds of Formula 3 when $R_3$ and $R_4$ are alkyl are commercially available from Alfa Aesar. Tris(dimethylamino)methane is commercially available from Sigma-Aldrich of St. Louis, Mo., and Shanghai Hanhong Chemical Co. Ltd.

"Hydrocarbon fluid" means a liquid, gas, or mixture thereof that predominantly comprises aliphatic and/or aromatic hydrocarbons. The hydrocarbon fluid may be crude, partially refined, or fully refined. The hydrocarbon fluid of the present invention includes, but is not limited to, natural gas, crude oil, field oil, fuel oil, naphtha, gasoline, kerosene, diesel, refinery gas, coal gas, tar, asphalt, coke gas, ammonia synthesis gas, gas from a sulfurization plant, or an industrial gas stream.

Having described the invention in detail, it will be apparent that modifications and variations are possible without departing from the scope of the invention defined in the appended claims.

EXAMPLES

The following non-limiting examples are provided to further illustrate the present invention.

Example 1

Hydrogen Sulfide Performance Testing of Scavenger Compounds of Formulae 1 to 3

A modified Can Test Method ASTM D5705 was conducted in samples of kerosene spiked with hydrogen sulfide saturated LVT200 solution (a model oil available from DeepSouth Chemical). Quart metal cans were filled with 500 ml of the spiked kerosene and quickly capped to ensure hydrogen sulfide did not escape. After two hours at room temperature, the samples were shaken and initial hydrogen sulfide headspace concentrations were determined using hydrogen sulfide detector tubes. The samples were then treated with the scavenger compound and shaken. After two hours at room temperature, the samples were shaken and the final hydrogen sulfide headspace concentrations were determined.

| Scavenger | Sample Description | Initial $H_2S$ Conc. (ppm) | Final $H_2S$ Conc. (ppm) | Scavenger Dose (ppm) | Dose Ratio (scavenger/ $H_2S$/) | % Reduction |
|---|---|---|---|---|---|---|
| Untreated | | 1300 | 1300 | 0 | 0 | 0.0 |
| DFDA | N,N-Dimethylformamide Dimethyl Acetal | 1300 | 0 | 650 | 0.5 | 100.0 |
| DFDEA | N,N-Dimethylformamide Diethyl Acetal | 1300 | 0 | 650 | 0.5 | 100.0 |
| DADA | N,N-Dimethylacetamide Dimethyl Acetal | 1300 | 0 | 650 | 0.5 | 100.0 |
| TDM | Tris(dimethylamino) methane | 1300 | 0 | 650 | 0.5 | 100.0 |
| EC9085A | MMA Triazine | 1300 | 10 | 650 | 0.5 | 100.0 |

These results indicate the N,N-Dimethylformamide dimethyl acetal (DFDA) and other acetals were able to achieve greater than 99% reduction in vapor phase $H_2S$ when compared to the SULFA-CHECK™ EC9085A at a 0.5 dose ratio.

Example 2

Hydrogen Sulfide Performance Testing Using Varying Dose Ratios

A modified Can Test Method ASTM D5705 was conducted as described in Example 1 using different samples of kerosene spiked with hydrogen sulfide saturated LVT200 solution.

| Scavenger | Sample Description | Initial $H_2S$ Conc. (ppm) | Final $H_2S$ Conc. (ppm) | Scavenger Dose (ppm) | Dose Ratio (scavenger/ $H_2S$ | % Reduction |
|---|---|---|---|---|---|---|
| Untreated | | 2500 | 2500 | 0 | 0 | 0.0 |
| DFDA | N,N-Dimethyl-formamide Dimethyl Acetal | 2500 | 500 | 250 | 0.1 | 80.0 |
| DFDA | N,N-Dimethyl-formamide Dimethyl Acetal | 2500 | 0 | 500 | 0.2 | 100.0 |
| DFDA | N,N-Dimethyl-formamide Dimethyl Acetal | 2500 | 0 | 750 | 0.3 | 100.0 |
| DADA | N,N-Dimethyl-acetamide Dimethyl Acetal | 2500 | 300 | 250 | 0.1 | 88.0 |
| DADA | N,N-Dimethyl-acetamide Dimethyl Acetal | 2500 | 0 | 500 | 0.2 | 100.0 |
| DADA | N,N-Dimethyl-acetamide Dimethyl Acetal | 2500 | 0 | 750 | 0.3 | 100.0 |
| EC9085A | | 2500 | 800 | 250 | 0.1 | 68.0 |
| EC9085A | | 2500 | 400 | 500 | 0.2 | 84.0 |
| EC9085A | | 2500 | 150 | 750 | 0.3 | 94.0 |

This test compared the dose response between N,N-Dimethylformamide dimethyl acetal (DFDA), N,N-Dimethylformamide dimethyl acetamide (DADA) and SULFA-CHECK™ EC9085A in kerosene. The results show that the acetals gave better performance than the SULFA-CHECK™ EC9085A at the lower 0.1 to 0.3 dose ratios.

Example 3

Hydrogen Sulfide Performance Test in Fuel Oil

A modified Can Test Method ASTM D5705 was conducted in samples of fuel oil. Quart metal cans were filled with 500 ml of the fuel oil and quickly capped to ensure hydrogen sulfide did not escape. Each sample was put in an oven set at 90° C. to simulate the system temperature. After two hours, each of the samples was shaken and its initial hydrogen sulfide headspace concentration was determined using hydrogen sulfide detector tubes. The scavenger compound was added to each treated sample and each sample was shaken and returned to the hot water bath. After two hours, each of the samples was shaken and its final hydrogen sulfide headspace concentration was determined

| Scavenger | Initial $H_2S$ Conc. (ppm) | Final $H_2S$ Conc. (ppm) | Scavenger Dose (ppm) | Dose Ratio (Scavenger/ $H_2S$) | % Reduction | Reaction Ratio |
|---|---|---|---|---|---|---|
| Untreated | 600 | 500 | 0 | 0 | | |
| DFDA | 600 | 400 | 60 | 0.1 | 33 | 0.3 |
| DFDA | 600 | 150 | 120 | 0.2 | 75 | 0.3 |
| DFDA | 600 | 10 | 180 | 0.3 | 98 | 0.3 |
| DADA | 600 | 400 | 60 | 0.1 | 33 | 0.3 |
| DADA | 600 | 300 | 120 | 0.2 | 50 | 0.4 |
| DADA | 600 | 140 | 180 | 0.3 | 77 | 0.5 |
| EC9085A | 600 | 130 | 60 | 0.3 | 78 | 0.4 |
| EC9085A | 600 | 75 | 120 | 0.4 | 88 | 0.5 |
| EC9085A | 600 | 10 | 180 | 0.6 | 98 | 0.6 |

This test compared the dose response between N,N-dimethylformamide dimethyl acetal (DFDA), N,N-dimethylacetamide dimethyl acetal (DADA) and SULFA-CHECK™ EC9085A in fuel oil. The results showed that the DFDA gave better performance than the SULFA-CHECK™ EC9085A at the 0.1 to 0.3 dose ratios. SULFA-CHECK™ EC9085A only begins to show similar performance to DFDA at 0.4-0.6 dose ratios.

Example 4

Mercaptan Performance Test in Kerosene

A modified version of ASTM D5705 test method was used. Each 500 mL bottle was filled to the 200 mL mark with kerosene and spiked with 1000 ppm of n-butanethiol (200 μL). Each sample was dosed with the scavenging agent, shaken for a minute, and allowed to stand overnight. A draeger tube was then inserted to determine the vapor phase mercaptan concentration and recorded. The test was carried out at room temperature and a residence time 23 hours.

| Scavenger | Sample Description | Dose ppm | Mercaptan Conc. Ppm |
|---|---|---|---|
| Untreated | Blank | 0 | 80 |
| DFDA | N,N-Dimethyl-formamide Dimethyl Acetal | 2000 | 40 |
| DFDA | N,N-Dimethyl-formamide Dimethyl Acetal | 3000 | 45 |
| EC5010A | | 2000 | 24 |

This test compared N,N-dimethylformamide dimethyl acetal (DFDA) and EC5010A (available from Nalco Champion) in kerosene. The results showed that the DFDA was effective at reducing n-butanethiol levels in kerosene.

Example 5

Synthesis of N,N-Dimethylformamide Dimethyl Acetal (DFDA)

The synthetic procedure is adapted from the Journal of Organometallic Chemistry (Mesnard D.; Miginiac L. *Journal of Organometallic Chemistry,* 373 (1989) 1-10).

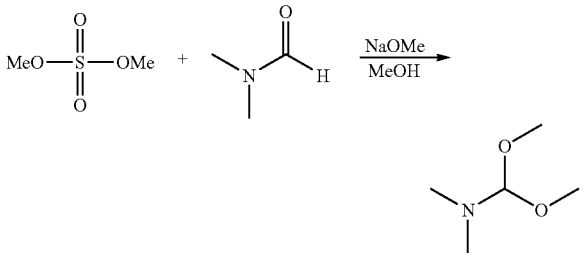

A 50 mL 3-neck round bottom flask kept under a nitrogen sweep was charged with dimethyformamide (7.3 g, 0.1 mol) and dimethyl sulfate (12.6 g, 0.1 mol). The mixture was heated at 80° C. for 2 hours. The reaction mixture was then cooled and washed with an equal volume of anhydrous benzene and ether. The traces of solvent were eliminated under reduced pressure. A solution of sodium methoxide (NaOMe) (5.4 g, 0.1 mol) in methanol (MeOH) (35 mL) at −10° C. was then added slowly to the complex obtained in the first step. The reaction mixture was then brought to room temperature and distilled under reduced pressure and collected at 40° C. in a flask containing 0.5 g magnesium sulfate ($MgSO_4$). The product was quickly redistilled to remove methanol, giving rise to the DFDA in 70% yield.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the methods without departing from the scope of the invention, it is intended that all matter contained in the above description and shown in the accompanying drawings shall be interpreted as illustrative and not in a limiting sense.

What is claimed is:

1. A method of reducing the amount of hydrogen sulfide or a mercaptan in a hydrocarbon fluid comprising contacting the hydrocarbon fluid with an effective amount of a scavenger composition to reduce the amount of hydrogen sulfide or mercaptan in the hydrocarbon fluid, the scavenger composition comprising a compound of formula 1 having the structure:

Formula 1

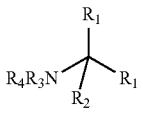

wherein $R_1$ is independently —$NR_3R_4$, —$O(CH_2)_nNR_5R_6$, or —$OR_7$;

$R_2$, $R_3$, $R_4$, $R_5$, and $R_6$ are independently hydrogen, alkyl, alkenyl, or alkynyl;

$R_7$ is alkyl, alkenyl, or alkynyl;

n is an integer from 1 to 10; and $R_2$ is hydrogen when $R_1$ is —$NR_3R_4$.

2. The method of claim 1 wherein the compound of formula 1 has the structure of formula 2 or 3:

Formula 2

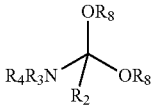

Formula 3

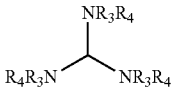

wherein $R_8$ is independently alkyl, alkenyl, alkynyl, or —$(CH_2)_nNR_5R_6$.

3. The method of claim 2 wherein $R_3$, $R_4$, $R_5$, $R_6$, $R_7$ and $R_8$ are $C_1$ to $C_{20}$ alkyl and $R_2$ is hydrogen or $C_1$ to $C_{20}$ alkyl.

4. The method of claim 3 wherein $R_3$, $R_4$, $R_5$, $R_6$, $R_7$ and $R_8$ are independently methyl, ethyl, propyl, butyl, pentyl, or hexyl.

5. The method of claim 4 wherein $R_8$ is methyl or ethyl.

6. The method of claim 5 wherein $R_2$ is hydrogen, methyl or ethyl.

7. The method of claim 6 wherein $R_3$ and $R_4$ are independently hydrogen, methyl, ethyl, propyl, or butyl.

8. The method of claim 7 wherein $R_5$ and $R_6$ are independently hydrogen, methyl, ethyl, propyl or butyl.

9. The method of claim 8 wherein $R_8$ is methyl.

10. The method of claim 9 wherein $R_2$ is hydrogen.

11. The method of claim 10 wherein $R_3$ and $R_4$ are methyl.

12. The method of claim 2 wherein the effective amount of the compound of formula 2 or 3 is from 5 to 10,000 ppm in the hydrocarbon fluid.

13. The method of claim 9 wherein $R_2$ is methyl.

14. The method of claim 8 wherein $R_8$ is ethyl.

15. The method of claim 1 wherein the scavenger composition consists essentially of or consists of the compound of Formula 1.

16. The method of claim 1 wherein the hydrocarbon fluid is a liquid.

17. The method of claim 16 wherein the liquid is crude oil, field oil, asphalt, fuel oil, naphtha, gasoline, kerosene, or diesel.

18. The method of claim 17 wherein the liquid is crude oil.

19. The method of claim 1 further comprising storing the hydrocarbon fluid in a storage tank, rail car, tank truck, or pipeline after it is contacted with the composition.

20. The method of claim 19 wherein the hydrocarbon fluid is stored in a storage tank.

21. The method of claim 20 wherein the composition is contacted with the hydrocarbon fluid by injecting the composition into the storage tank with mixing.

22. The method of claim 1 wherein the composition is contacted with the hydrocarbon fluid by injecting the composition into a run-down line for the hydrocarbon fluid.

* * * * *